US008500212B2

(12) United States Patent
Crutchley et al.

(10) Patent No.: US 8,500,212 B2
(45) Date of Patent: Aug. 6, 2013

(54) APPLICATOR BRUSH HAVING DECORATED FIBERS AND ASSOCIATED METHOD OF MANUFACTURE

(75) Inventors: Ed Crutchley, Kent (GB); Nicholas Thorne, Seyssins (FR); Sylvain Gourmet, Saint Leu la Foret (FR)

(73) Assignee: Albea Services (FR)

( * ) Notice: Subject to any disclaimer, the term of this patent is extended or adjusted under 35 U.S.C. 154(b) by 247 days.

(21) Appl. No.: 12/887,280

(22) Filed: Sep. 21, 2010

(65) Prior Publication Data

US 2011/0163592 A1 Jul. 7, 2011

(30) Foreign Application Priority Data

Sep. 21, 2009 (EP) ..... 09305876

(51) Int. Cl.
*A46D 1/04* (2006.01)

(52) U.S. Cl.
USPC ..... 300/21; 8/478

(58) Field of Classification Search
USPC ..... 300/21; 8/478; 132/218
See application file for complete search history.

(56) References Cited

U.S. PATENT DOCUMENTS

| | | | | |
|---|---|---|---|---|
| 2003/0084913 | A1 * | 5/2003 | Gueret | 132/218 |
| 2008/0060669 | A1 | 3/2008 | Malvar et al. | |
| 2009/0071500 | A1 * | 3/2009 | Wyatt et al. | 132/218 |

FOREIGN PATENT DOCUMENTS

| | | | |
|---|---|---|---|
| DE | 718 274 | C | 3/1942 |
| DE | 101 23 329 | A1 | 11/2002 |
| EP | 0 239 270 | A2 | 9/1987 |
| EP | 0 303 202 | A1 | 2/1989 |
| GB | 2 343 142 | A | 5/2000 |
| WO | 2006/036535 | A1 | 4/2006 |

OTHER PUBLICATIONS

European Search Report Dated Apr. 15, 2010 for European Application EP 09 30 5876.6 (the priority document).

* cited by examiner

*Primary Examiner* — Randall Chin
(74) *Attorney, Agent, or Firm* — Banner & Witcoff, Ltd.

(57) ABSTRACT

According to an aspect of the invention there is provided a method of manufacturing an applicator brush for use in applying a product, such as a cosmetic product, the method comprising providing a plurality of fibers, decorating the fibers so as to define at least one colored region, and fitting the decorated fibers to a stem so as to define a cosmetic applicator brush, wherein the step of decorating the fibers includes a step of coloring the fibers using dye sublimation so that individual fibers have an outer colored region and an inner uncolored region. In an embodiment, an individual fiber is decorated with a color that is different to another individual fiber extending from the stem. Alternatively, or in addition, an individual fiber is decorated with at least two colors.

16 Claims, 2 Drawing Sheets

APPLICATOR BRUSH HAVING DECORATED FIBERS AND ASSOCIATED METHOD OF MANUFACTURE

CROSS-REFERENCE TO RELATED APPLICATIONS

This application claims the benefit under 35 U.S.C. 119 of European Patent Application EP 09 30 5876.6, filed Sep. 21, 2009, which is hereby incorporated by reference in its entirety.

FIELD OF THE INVENTION

This invention relates to a method of manufacturing applicator brushes having decorated fibers and to an applicator brush obtained by such a method.

BACKGROUND OF THE INVENTION

Cosmetic applicator brushes, and in particular, mascara brushes, are typically made using black synthetic fiber, such as Nylon. A typical fiber diameter is 4 mils (i.e. 0.1 millimeter).

There is, however, an increasing demand for cosmetic brushes to have differently colored fibers and/or fibers that are individually multi-colored, on the same brush. The reasons for this include:

1. To create an attractive presentation to a potential consumer, before use.
2. To represent a code for the consumer to easily recognize a particular cosmetic product within a range of products. In such a case, for example, a mascara package may be presented to the consumer as a separate container and brush, rather than the brush being already inserted into the mascara as is currently the practice.
3. To promote a particular brush feature by providing a different color on that specific part of the brush.

Currently, the fiber used for mascara brushes is typically manufactured by specialist companies using multi-filament extrusion. The fiber is subsequently fed into a brush-making machine typically located elsewhere, at a second specialist company. Although in theory it may be possible to run colored fiber in this process, and although the decorative effect could be enhanced by running different colored fibers next to each other into the brush-making machine, such an approach is hampered by the difficulty of changing over color on an extrusion line. In particular, the cost of color changeover, by virtue of the necessity to completely purge the extrusion equipment in order to remove even the slightest traces of the previous pigmentation, renders colored fiber both expensive and subject to minimum quantities. Also, the perturbation that such changes create implies that lead-times for special colors are relatively long. As a result, the use of colored fibers today is limited, despite the perceived level of demand. Black thus remains the most common color, by far.

Although it is possible to mass extrude fibers so that all the fibers of a brush are the same color, this would only be of a very limited use.

There is therefore a need to be able to more easily produce smaller quantities of colored fiber with a short lead-time, and at the same time to have the possibility of a wider range of decorative effects.

SUMMARY OF THE INVENTION

In accordance with an aspect of the invention there is provided a method of manufacturing an applicator brush, the method comprising:

providing a plurality of fibers;

decorating the fibers so as to define at least one colored region; and fitting the decorated fibers to a stem so as to define a cosmetic applicator brush, wherein the step of decorating the fibers includes a step of coloring the fibers by dye sublimation so that individual fibers have an outer, colored region and an inner uncolored region.

In an embodiment, the outer colored region is the result of color infiltration up to a radial depth of approximately 20 μm.

In an embodiment, the step of decorating the fibers results in at least two distinctly colored regions.

In an embodiment, the step of decorating the fibers includes the step of decorating an individual fiber with a color that is different to another individual fiber for the same brush.

Alternatively, or in addition, the step of decorating the fibers includes the step of decorating an individual fiber with at least two colors.

In an embodiment, the step of providing a plurality of fibers includes the step of providing a multiplicity of fibers, and the step of fitting the decorated fibers includes the step of radially fitting the multiplicity of fibers to the stem.

In an embodiment, the step of decorating the fibers includes the step of distinguishing the at least one colored region so that when fitted to the stem, the at least one colored region is distinguishable axially along the length of the stem, radially relative to the stem or circumferentially around the stem, or a combination of these.

In an embodiment, the step of using dye sublimation includes the step of bringing the fibers into contact with a carrier medium carrying a dye to be transferred and applying heat to the carrier medium.

In an embodiment, the method comprises printing the dye according to a pattern that corresponds to the at least one colored region.

In an embodiment, the carrier medium is sandwiched between a heated cylinder or a heated platen and a backing.

In an embodiment, the backing is also heated.

In an embodiment, the carrier medium is paper and the dye is contained in ink printed onto the paper.

In an embodiment, the carrier medium carries at least two differently colored inks so as to define the distinctly colored region.

In an embodiment, the method comprises bundling a plurality of fibers and decorating the bundled fibers so as to define the at least one colored region.

The applicator brush can be a cosmetic applicator brush for use in applying cosmetic product.

In particular, the cosmetic applicator brush can be a mascara applicator brush and the cosmetic product is mascara.

Alternatively, the applicator brush can be a toothbrush.

DETAILED DESCRIPTION OF PREFERRED EMBODIMENTS

Figure 1:
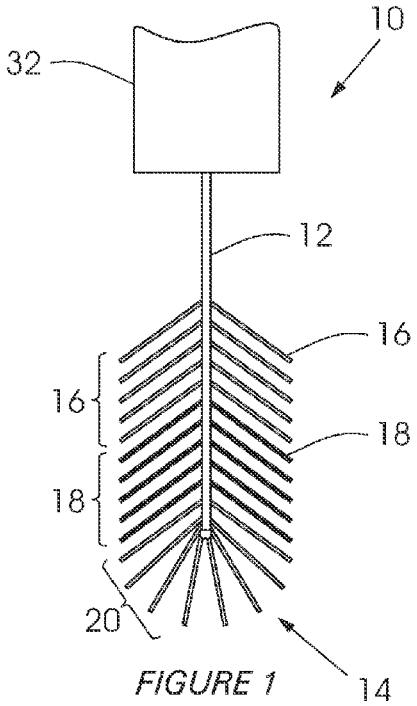
FIG. 1 shows a side view of a cosmetic applicator brush having decorated fibers, according to a first embodiment of the invention, wherein a multiplicity of decorated fibers extends radially from a stem, with colored regions being distinguishable axially along the length of the stem.
Figure 2:
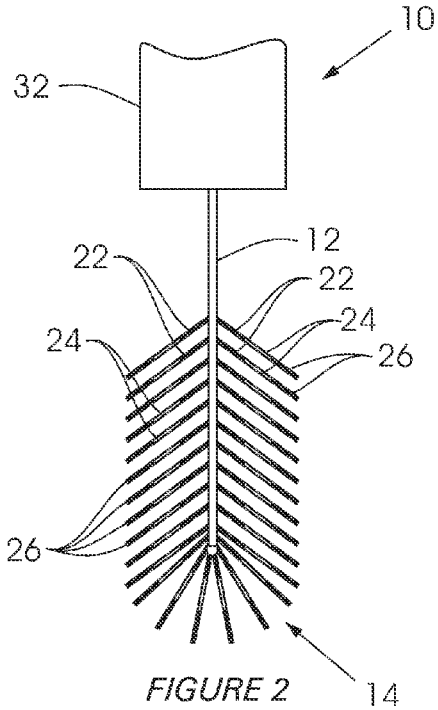
FIG. 2 shows a side view of a cosmetic applicator, according to a second embodiment of the invention, wherein colored regions are distinguishable radially relative to the stem.
Figure 3:
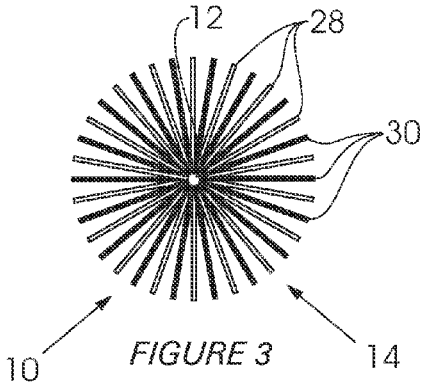
FIG. 3 shows a side view of a cosmetic applicator, according to a third embodiment of the invention, wherein colored regions are distinguishable circumferentially around the stem.

Referring first to FIGS. 1 to 3, a cosmetic applicator brush 10 for use in applying a cosmetic product is shown. The applicator brush 10 comprises a stem 12 from which a plurality, and typically a multiplicity, of decorated fibers 14 extend radially. The decorated fibers 14 define distinctly colored regions 16, 18, 20 and 22, 24, 26, and 28, 30, in FIGS. 1, 2 and 3, respectively.

In an embodiment, as shown in FIGS. 1 and 3, individual fibers within the colored regions 16, 18, 20 and 28, 30 are decorated with a color that is different to other individual fibers extending from the stem 12. In particular, and with reference to FIG. 1, the colored regions 16, 18 and 20 are distinguishable axially along the length of the stem 12, in which case each colored region 16, 18, 20 comprises individual fibers having a single color applied thereto. In FIG. 3, the colored regions 28, 30 are distinguishable circumferentially around the stem 12. In a variation to the brush shown in FIG. 3, the radially extending fibers may be divided into two or more distinct circumferential sectors around the stem 12, each sector having decorated fibers 14 with a particular color.

Alternatively, as shown in FIG. 2, or in addition to the distinctly colored regions shown in FIGS. 1 and 3, an individual fiber is decorated with at least two colors 22, 24, 26. Thus, the colored regions 22, 24, 26 are distinguishable radially relative to the stem 12.

Although the colored regions 22, 24, 26 are shown as being perfectly aligned across the fibers 14, it should be appreciated that in practice this may be difficult to achieve using conventional brush making machinery. Thus, although the fibers 14 have distinctly colored regions 22, 24, 26 along each fiber, each individual fiber would typically be cut and mounted randomly. As a result, the regions 22, 24, 26 may not in practice be as clearly defined as illustrated in FIG. 2. However, with relatively expensive and sophisticated brush making machinery, it may be possible to achieve consistently the illustrated, perfectly aligned colored regions 22, 24, 26 across the fibers.

Accordingly, the embodiment shown in FIG. 2 is included for illustrative purposes only, and is not meant to limit the scope of protection defined in the accompanying claims. A similar comment applies with respect to the toothbrush embodiment illustrated in FIG. 6, and which shall be described in more detail further below.

The versions shown in FIGS. 1 to 3 are just some examples in which the decorated fibers 14 may define distinctly colored regions. A combination of the distinctly colored regions in FIGS. 1 to 3 may also be used so as to create more imaginative effects. These may include randomly dispersed patterns, spiral effects along the decorated fibers 14, and color or intensity variation along the stem 12.

In an embodiment, the cosmetic applicator brush 10 is a mascara applicator brush and the cosmetic product is mascara, with the stem 12 being connectable to a handle component 32.

The coloring of the decorated fibers 14 may be achieved using dye sublimation. Coloring synthetic fibers using dye sublimation is well known, in which dyes are absorbed, under heat, by the fiber. These dyes are typically contained in inks printed onto a carrier medium, such as paper, which is brought into contact with the fibers exclusively for the transfer of the dye contained inside the ink. Sublimation has the distinct advantage over other decorative processes in that the dye is sealed inside the fiber, and therefore presents a maximum degree of resistance for exposure to products, such as mascara. There is in addition no risk of flaking off or loss of adhesion as may be the case for alternative surface inks or coatings. Because the sublimation technique commences with a multi-color printing process, image manipulation can be used to create a wide variety of colors and patterns, as indicated above, not just uniform single colors. This increases the range of effects possible.

A unique feature of the cosmetic applicator brush 10 is thus that the sublimation process is carried out before the fibers 14 are fitted to the stem 12 to define the brush 10. Sublimation on textiles, for example, is carried out after weaving, and the final decoration is essentially flat, so that individual adjacent fibers cannot be decorated differently. In the present invention, however, a three-dimensional object, namely a mascara brush 10, is created after sublimation. Such a process thus allows the manipulation of decorative effects not possible by conventional techniques.

Figure 4A:
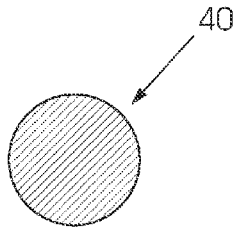
FIGURE 4A (PRIOR ART)
FIG. 4A shows a cross-sectional view of a prior art pigmented, extruded fiber.
Figure 4B:
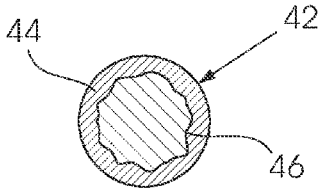
FIG. 4B shows a cross-sectional view of a fiber used in the present invention, comprising an outer, colored region and an inner uncoloured region.

A side-by-side comparison between a cross-sectional view of a prior art pigmented, extruded fiber and a cross-sectional view of a fiber used in the present invention is useful, and will now be described with reference to FIGS. 4A and 4B. In the prior art bristle fiber 40 shown in FIG. 4A, the color of the fiber 40 is evenly distributed throughout the cross-sectional area of the bristle fiber 40, all the way to the center. In contrast, as shown in FIG. 4B, the fiber 42 used in the present invention, as a result of the dye sublimation process described above, comprises an outer, colored region 44 and an inner uncoloured region 46. In other words, the bristle fiber 42 of the invention has a cross-section in which the color infiltrates from the outer surface, in a radial direction, up to a depth of approximately 20 μm (micrometers). As shown in FIG. 4B, the color infiltration is not even, and thus the interface between the regions 44, 46 is not smooth. The diameter of the bristle fibre 42 is typically around 100 μm.

Figure 5:
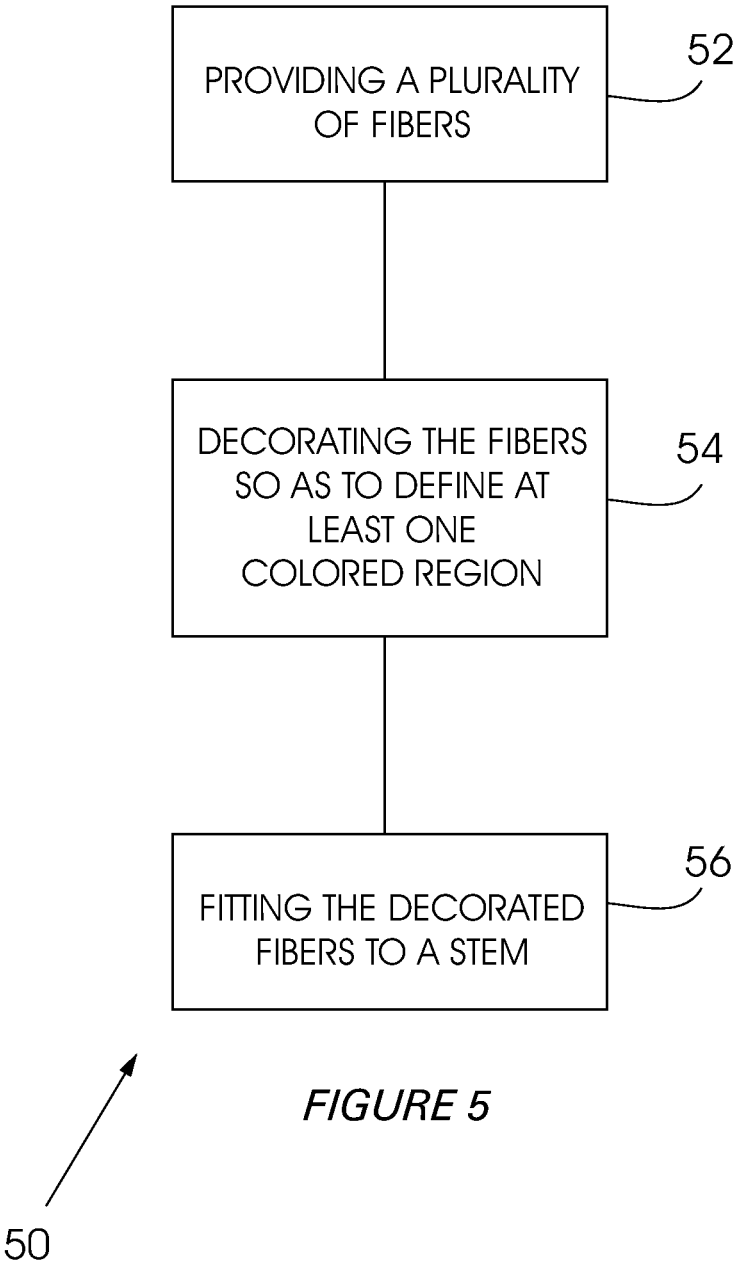
FIG. 5 shows a flow chart representing a method of manufacturing a cosmetic applicator brush according to a further aspect of the invention.

Turning now to FIG. 5, a second aspect of the present invention provides a method 50 of manufacturing a cosmetic applicator brush. The method 50 comprises providing a plurality, and typically a multiplicity, of fibers, as indicated by block 52. The fibers may be extruded in the usual manner, without any color, or with only a light coloring. Where the fiber substrate is a synthetic material, such as nylon, containing no or only a small amount of colorant facilitates the coloring of the fiber, which will be discussed in more detail further below. In use, fiber for brush-making is typically provided in spools, with each spool carrying 75 or 100 strands per spool.

The method 50 further comprises decorating the fibers so as to define at least one colored region, as indicated by block 54. In an embodiment, the step of decorating the fibers includes the step of decorating an individual fiber with a color that is different to another individual fiber for the same brush.

Alternatively, or in addition, the step of decorating the fibers includes the step of decorating an individual fiber with at least two colors.

The method 50 concludes by radially fitting the decorated fibers to a stem so as to define a cosmetic applicator brush, as indicated by block 56.

The step of decorating the fibers may include the step of distinguishing the at least one colored region so that when fitted to the stem, the at least one colored region is distinguishable axially along the length of the stem, radially relative to the stem or circumferentially around the stem, or a combination of these.

In an embodiment, the step of decorating the fibers so as to define at least one colored region includes the step of coloring the fibers using dye sublimation. In one version, the step of using dye sublimation includes the step of bringing the fibers into contact with a carrier medium, such as paper, carrying an ink dye to be transferred, and applying heat to the carrier medium. The heat causes the dye to sublimate from the carrier medium into the fiber and thus become sealed within the fiber.

The method may comprise printing the ink dye according to a pattern that corresponds to the distinctly colored regions. Thus, the pattern to be sublimated is prepared in full knowledge of the brush-making process in order to obtain the decorative effect desired. The pattern may be printed onto a carrier medium in any one of a number of conventional printing processes, such as ink-jet, gravure, and offset, whereby the image to be printed may be generated from electronic artwork. Typically, the carrier medium used to hold the printed image is in the form of web, since long lengths of fiber are ultimately to be decorated. For example, a production run might be of 100,000 brushes, which, at 12 mm per brush, translates into a requirement of 1200 meters (i.e. 1.2 kilometers)

In an embodiment, the carrier medium is sandwiched between a heated cylinder or a heated platen (provided the fiber advance could be stopped and started accordingly) and a backing.

Advantageously, the backing may be heated. The reason for this is that the decoration of individual fibers by dye sublimation introduces an effect that is less noticeable with woven fabrics, namely a heat sink phenomenon. A normal sublimation process can be carried out with a heated cylinder or platen and a cold backing. It was found, however, that because the backing is considerably more exposed in single fiber decoration, there is a more significant heat sink effect. To compensate for this, it has been found that pressure has to be optimized. However, if too much pressure is applied, the heat sink effect has a larger effect, and the exposure time to ensure dye transfer has to be increased by as much as if there was much less nip pressure.

It has equally been found that if a cold backing is used, higher temperatures are required to ensure the same amount of sublimation. Since the melting point of the polymer being decorated is around 250° C., there is a real danger of deforming the fibers with heat.

The heat sink effect also manifests itself in the overall cycle time of the process. If a cold backing is used, and the nip pressure is optimized, depending on the temperature, about 10 to 20 seconds is required in order to get full transfer.

It has been found, however, that if the backing is heated, the cycle time for an equivalent degree of dye transfer can be reduced by at least ten times, and temperatures can be also dropped closer to 205° C., which is a typical temperature required for sublimation. This is important, in that the melting point of the polymer is around 250° C., and an increased difference between this temperature and sublimation temperature will ensure that fibers are not deformed.

It has to be added that the exposure of individual fibers to tension under heat creates potential risks of undesired fiber elongation if careful tension control is not employed.

In a further embodiment, the method comprises bundling a plurality of fibers and decorating the bundled fibers so as to define at least one colored region. It was also discovered that a simplification of the process could be achieved by bundling the fibers, i.e. allowing some degree of overlap, avoiding the need to range the fibers individually, but spreading them out enough in order to get some degree of transfer on a sufficient number the fibers as to create a sufficient visual effect.

The final step of fitting the decorated fibers to a stem so as to define a cosmetic applicator brush is carried out on specialized machines such as manufactured by, for example, Zahoransky. A typical speed of such a machine may be 60 brushes a minute, a typical fiber length consumed per brush before trimming may be 12 mm, so an in-line printing device should have a speed of at least 60×12/1000 meters/minute=0.72 meters per minute. An off-line system could run considerably faster, if the dye sublimation process allows it.

The dye sublimation process may be carried out either in-line with extrusion, as an independent spool-to-spool process, or in line with brush-making, but in any case before the brush-making process. If the fiber is running from a spool, i.e. not in line with the extrusion process, the spool is unwound, the pattern transferred to the individual fibers in a heat transfer press, cooled, and then rewound (unless it runs directly into a brush-making machine).

Two types of sublimation printing processes may be used. The first is an indexing system, which temporarily stops the fiber so that it can be decorated by a descending platen. The second is a continuous rotary system, in which cylinders turn without stopping.

Trials were conducted on a platen principle, using a prescribed carrier paper decorated by ink-jet, and printed with Sawgrass sublimation inks. When decoration was carried out using a heated silicone die platen and room temperature backing, with the silicon die surface temperature ranging from 200° C. to 260° C., the cycle time needed for dye transfer was in the order of 10 seconds or more, and preferably at least 15 seconds at about 240° C. at the heated silicone surface. It was found, however, that, in order to avoid the heat sink effect caused by the colder backing, as described above, platen pressure had to be optimized, and that the optimum pressure allowed the fiber and carrier paper to be moved around in the nip. If the nip was reduced, dye transfer was lessened.

It was, however, also discovered that if the same process was carried out using a heated backing, at a temperature similar to the platen, cycle times could be reduced by at least 10 times, to around between 1 and 2 seconds, with the silicone die temperature being reduced to about 205° C. The conclusion was thus that in the previous case, the lack of a heated backing caused a heat sink.

Figure 6:
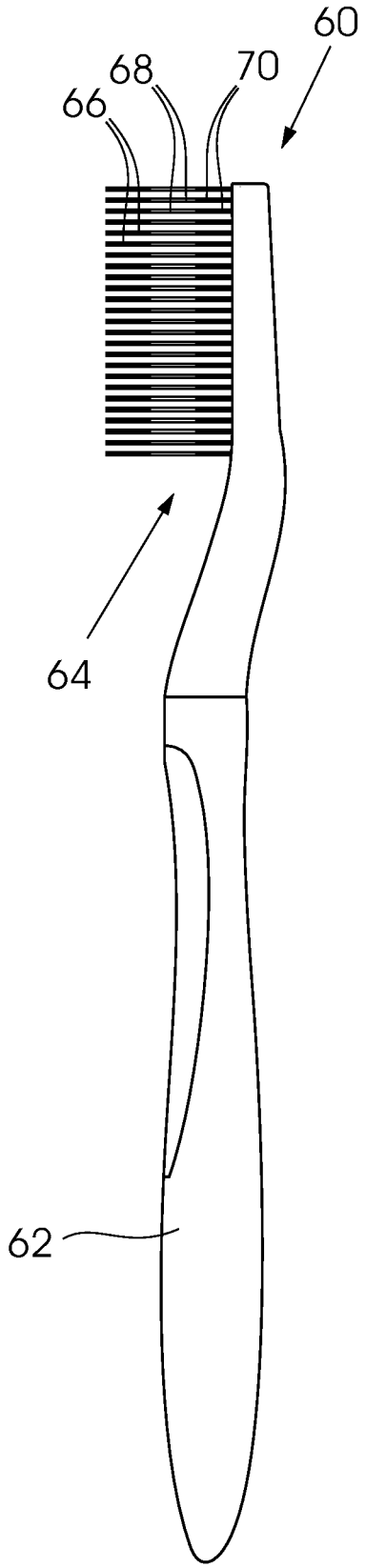
FIG. 6 shows a side view of a toothbrush, according to a further embodiment of the invention.

The invention has been described above with reference to a cosmetic applicator brush. However, with reference now to FIG. 6, it is envisaged that the invention could also be applied to other applicator brushes, such as a toothbrush 60. As shown in FIG. 6, the toothbrush 60 comprises a handle 62 from which a plurality, and typically a multiplicity, of decorated fibers 64 extend at one end of the toothbrush 60. The decorated fibers 64 define distinctly colored regions 66, 68 and 70, the colored regions being distinguishable along the length of each fiber. Significantly, the fibers 64 may be decorated using the dye sublimation process described above.

The present invention thus provides an applicator brush, whether a cosmetic applicator brush or a toothbrush, having differently colored fibers and/or fibers that are individually multi-colored, on the same brush. The invention extends to a method for making such an applicator brush in a convenient, versatile and time-efficient manner.

The invention claimed is:

1. A method of manufacturing an applicator brush, the method comprising:

providing a plurality of fibers;

decorating the fibers so as to define at least one colored region; and fitting the decorated fibers to a stem so as to define an applicator brush, wherein the step of decorating the fibers includes a step of coloring the fibers by dye sublimation so that individual fibers have an outer, colored region and an inner uncolored region.

2. The method according to claim 1, wherein the outer colored region is the result of color infiltration up to radial depth of approximately 20 μm.

3. The method according to claim 1, wherein the step of decorating the fibers results in at least two distinctly colored regions.

4. The method according to claim 1, wherein the step of decorating the fibers includes a step of decorating an individual fiber with a color that is different to another individual fiber for the same brush.

5. The method according to claim 1, wherein the step of decorating the fibers includes the step of decorating an individual fiber with at least two colors.

6. The method according to claim 1, wherein the step of providing a plurality of fibers includes a step of providing a multiplicity of fibers, and a step of fitting the decorated fibers includes the step of radially fitting the multiplicity of fibers to the stem.

7. The method according to claim 1, wherein the step of decorating the fibers includes a step of distinguishing the at least one colored region so that when fitted to the stem, the at least one colored region is distinguishable axially along the length of the stem, radially relative to the stem or circumferentially around the stem, or a combination of these.

8. The method according to claim 1, wherein the step of using dye sublimation includes a step of bringing the fibers into contact with a carrier medium carrying a dye to be transferred and applying heat to the carrier medium.

9. The method according to claim 8, wherein the method comprises printing the dye according to a pattern that corresponds to the at least one colored region.

10. The method according to claim 9, wherein the carrier medium is sandwiched between a heated cylinder or a heated platen and a backing.

11. The method according to claim 10, wherein the backing is also heated.

12. The method according to claim 8, wherein the carrier medium is paper and the dye is contained in ink printed onto the paper.

13. The method according to claim 1, comprising bundling a plurality of fibers and decorating the bundled fibers so as to define the at least one colored region.

14. The method according to claim 1, wherein the applicator brush is a cosmetic applicator brush for use in applying cosmetic product.

15. The method according to claim 14, wherein the cosmetic applicator brush is a mascara applicator brush and the cosmetic product is mascara.

16. The method according to claim 1, wherein the applicator brush is a toothbrush.

* * * * *